US010663191B2

(12) United States Patent
Hultmark et al.

(10) Patent No.: US 10,663,191 B2
(45) Date of Patent: May 26, 2020

(54) DAMPER FOR VENTILATION SYSTEMS

(71) Applicant: LINDAB AB, Båstad (SE)

(72) Inventors: Göran Hultmark, Västra Frölunda (SE); Arne Kæseler, Vedbæk (DK)

(73) Assignee: LINDAB AB, Bastad (SE)

( * ) Notice: Subject to any disclaimer, the term of this patent is extended or adjusted under 35 U.S.C. 154(b) by 255 days.

(21) Appl. No.: 15/534,964

(22) PCT Filed: Dec. 15, 2015

(86) PCT No.: PCT/SE2015/051350
§ 371 (c)(1),
(2) Date: Jun. 9, 2017

(87) PCT Pub. No.: WO2016/105264
PCT Pub. Date: Jun. 30, 2016

(65) Prior Publication Data

US 2017/0343236 A1 Nov. 30, 2017

(30) Foreign Application Priority Data

Dec. 22, 2014 (SE) ..... 1451643

(51) Int. Cl.
*F24F 13/10* (2006.01)
*F24F 11/04* (2006.01)
(Continued)

(52) U.S. Cl.
CPC ..... *F24F 13/10* (2013.01); *F24F 11/74* (2018.01); *F24F 11/745* (2018.01); *F24F 13/1486* (2013.01); *F24F 2013/146* (2013.01)

(58) Field of Classification Search
CPC ..... F24F 13/10; F24F 13/1486; F24F 11/74; F24F 11/745; F24F 2013/146
See application file for complete search history.

(56) References Cited

U.S. PATENT DOCUMENTS 1,672,496 A * 6/1928 McFarland ..... F24F 13/1413 454/326
1,952,707 A * 3/1934 Germonprez ..... F24F 13/1426 454/327
(Continued)

FOREIGN PATENT DOCUMENTS

DE 2156897 A1 * 5/1973 ..... F24F 13/084
EP 1921394 A1 5/2008
(Continued)

OTHER PUBLICATIONS

International Search Report from corresponding International Patent Application No. PCT/SE2015/051350, dated Apr. 11, 2014.
(Continued)

*Primary Examiner* — Steven S Anderson, II
(74) *Attorney, Agent, or Firm* — Tucker Ellis LLP

(57) ABSTRACT

The present invention is relative to a damper (5) adapted to regulate an air flow orifice (7) for passing of an air flow in a ventilation duct (2), wherein the damper (5) comprises a plate (11), a regulating device (12) and a mounting element (13), wherein the mounting element (13) is resilient and comprises a first and a second end (19, 20), the distance (L1, L2) between the first and the second end (19, 20) being arranged to change when the mounting element (13) bends resiliently, and wherein the first and a seconds end (19, 20) are adapted to cooperate with an inside of the ventilation duct (2) to removably mount the damper (5) in the ventilation duct (2), and a ventilation system (1) comprising such a damper (5).

21 Claims, 7 Drawing Sheets

(51) Int. Cl.
*F24F 11/74* (2018.01)
*F24F 13/14* (2006.01)

(56) References Cited

U.S. PATENT DOCUMENTS 2,194,878 A 3/1940 Tracy
3,009,473 A * 11/1961 Hennen ..... F16K 1/223 137/315.22
3,456,571 A * 7/1969 Kelly ..... B60H 1/3407 454/145
4,587,706 A * 5/1986 Prikkel, III ..... G05D 23/08 236/1 G
5,186,385 A 2/1993 Karabin
5,236,391 A * 8/1993 Schaefer ..... A01K 1/0064 454/253
5,238,220 A 8/1993 Shell
6,203,423 B1 * 3/2001 Craw ..... F24F 13/1486 454/259
2010/0197217 A1 8/2010 Yoskowitz
2011/0183600 A1 * 7/2011 Chua ..... F24F 7/06 454/358
2012/0148387 A1 6/2012 Labrecque

FOREIGN PATENT DOCUMENTS

GB 2468292 A 9/2010
RU 2413110 C1 2/2011
SE 157746 C1 2/1957

OTHER PUBLICATIONS

International Preliminary Report on Patentability from corresponding International Patent Application No. PCT/SE2015/051350, dated Apr. 5, 2017.
Office Action from corresponding Russian Application No. 2017126087, dated May 20, 2019.

* cited by examiner

DAMPER FOR VENTILATION SYSTEMS

TECHNICAL FIELD

Ventilation of habitations, buildings and other constructions, comprising both inlet air ventilation and exhaust air ventilation.

BACKGROUND OF THE INVENTION

Ventilation systems commonly used in buildings often include a ventilation duct to one end of which a fan is connected. A ventilation device is provided at the other end. One or several dampers and pressure equalizing boxes are arranged in the ventilation duct and in the ventilation system for regulating the air flow at various positions along the ventilation duct. The ventilation duct often extends over several different areas in the building, for the ventilation of the areas. The damper is adjustable in the ventilation duct, here referred to as the air flow orifice, with which the air flow through the ventilation device between the ventilation duct and outlying area can be regulated. As the damper is connected to the ventilation duct, the air flow in to or out from the ventilation duct is regulated by adjusting the size of the air flow orifice by adjusting the position of the damper in the ventilation duct.

The air flow through a ventilation system depends on factors such as fan power, the dimensions of the ventilation duct and damper position that adjusts the size of the air flow orifice. The dimension of the ventilation duct refers here to its cross sectional area. When the ventilation system comprises a plurality of ventilation devices and dampers, the latter are generally set so that the various ventilation devices and dampers have different sizes at the air flow orifice thereby to adjust the pressure equalizing in the ventilation system. By adjusting the air flow orifice of the various ventilation devices and the dampers, unnecessarily high pressures may be throttled away. This allows a predetermined air flow to be achieved by respective ventilation devices and dampers, i.e. that a desired degree of ventilation to be obtained in all the areas in which one or several ventilation devices are provided, or in different parts of the ventilation system. Too low air flow causes insufficient ventilation, while too high air flow causes increased energy costs.

The air flow, i.e. the amount of inlet air or exhaust air, is generally set by current practice, depending on the dimensions of the ventilation duct. To achieve this air flow, a certain pressure equalizing is needed in the ventilation system.

One problem with ventilation systems is that dirt is accumulated in the system and the system must be cleared/cleaned periodically to have a good air environment in the ventilated areas. In order to clear thoroughly a ventilation system it is necessary to remove dampers from the system to make it possible for the clearing tools to have excess to clear the system.

For these ventilation systems there are also rules prescribing that they have to be cleaned periodically, for example in Sweden there is a Mandatory Ventilation Control (OVK).

A further problem with ventilation systems is that they are difficult to install, as they are often located in places with difficult access and where the space is limited.

A further problem with ventilation systems is that the requirements of the tolerances of the parts of the system are high to achieve a ventilation system that is tight and efficient.

A further problem with ventilation systems is that there is a great pressure on prices, both in the manufacture of parts and the installation of the ventilation systems.

A further problem with these systems is that they produce noise that may be perceived as disturbing. Therefore, for these ventilation systems, there are limit values for a recommended maximum sound power level. Sound is especially produced in the ventilation devices at the air flow through the opening to the surroundings, i.e. the air flow orifice. The limit values for the allowed sound power level produced by respective ventilation devices and dampers limit how large pressure drop that can be achieved over the ventilation device or the damper, i.e. which degree of opening the respective ventilation device and the damper may have. This also sets limits to which air flow can be obtained through the ventilation system.

As mentioned above, a ventilation system usually contains a plurality of ventilation devices and dampers at different distances from the fan. In ventilation systems for inlet air, the pressure generated by the fan is lowest at the ventilation device that is positioned farthest from the fan, and thus this ventilation device is set to maximum orifice, i.e. that this ventilation device has a maximum size of the air flow orifice. With farthest means the ventilation device that has the lowest pressure drop. The pressure required for this ventilation device to provide a specified air flow determines the operational condition of the fan. To minimize energy consumption, the pressure drop should be as low as possible. In ventilation systems for exhaust air, the principle for the pressure is reversed.

At same time, a specified air flow must be obtained also at the other ventilation devices and dampers, which are closer to the fan, and thus experiencing a greater pressure from the fan in inlet air systems. Therefore, a certain degree of throttling of the pressure over respective damper is necessary so that the air flow will neither exceed nor fall below a specified air flow. However, the recommended highest sound power level sets limits to how much pressure across a damper can be throttled, because of the noises generated by the flow of air through the damper. As we will describe more in detail here below, factors such as a size of the air flow orifice of the damper, the dimensions of the damper and the size of an air flow through the same have an impact on the sound power level generated in the ventilation device by the air flow passing there through. Therefore, the degree of throttling of the pressure on a damper that as maximum can be achieved over a damper, without exceeding the recommended highest sound power level, should be the as high as possible to obtain an effective ventilation throughout the entire ventilation system. Globally, all these factors thus set limitation for the ventilation system.

Even if ventilation systems for inlet air ventilation have been described here above, the same applies also on exhaust air ventilation, though the pressures are reversed.

SUMMARY

One object of the invention is to provide a damper and a ventilation system designed to entirely or partly solve the above problem.

One object is to provide a damper that is easy to mount and to dismount.

One object is to provide a ventilation system that has a low sound volume.

The above and other objects are achieved by means of a damper and a ventilation system according to the independent claims, embodiments of the damper and of the ventilation system are described in claims depending on the independent claims.

A damper in accordance with the independent claim comprises a damper adapted to regulate an air flow orifice for the passage of an air flow in a ventilation duct, wherein the damper comprises a plate, a regulating device and a mounting element, wherein the plate s mounted to the regulating device and the regulating device is mounted to the mounting element, wherein the mounting element is resilient and comprises a first and a second end, the distance between the first and the second end being arranged to change when the mounting element bends resiliently, and wherein the first and the second end are arranged to cooperate with an inside of the ventilation duct to removably mount the damper in the ventilation duct. An advantage of such a damper is that it is easy to mount and to dismount in a ventilation duct towards the inside of the ventilation duct without any need to have access to outside of the ventilation duct.

According to one aspect, the mounting element is formed of a metal wire, which has the advantage that the mounting element can be used at a low price while obtaining high quality.

According to one aspect, the damper is arranged to cooperate with an internal groove of the ventilation duct, which has the advantage that the damper can be stably mounted in the ventilation duct, while its position can be predetermined in a simple manner.

According to one aspect, the plate is mounted to the regulating device and the regulating device is mounted to the mounting element, which results in an easy mounting of the damper, which reduces the manufacturing costs.

According to one aspect, the regulating device is rotatably mounted on the mounting element, which has the advantage that the damper can be easily regulated after having been mounted in the ventilation duct.

According to one aspect, the size of the air flow orifice is arranged to be regulated when the plate is rotated in the ventilation duct. According to one aspect, the mounting element is arranged to be mounted perpendicularly to the direction of the air flow in the ventilation duct.

According to one aspect, the plate is placed at a distance from the mounting element, which has the advantage that the plate can be mounted offset in relation to the position in which the mounting element cooperates. A further advantage of this is that the plate may be completely or partially outside the ventilation duct while the damper is mounted in the ventilation duct. According to tests, this has proved to give a low sound image.

According to one aspect, the damper is arranged to cooperate with a ventilation duct having a circular cross section, which gives the advantage that the damper can be easily positioned in the ventilation duct.

According to one aspect, the regulating device comprises at least one substantially circular hole, which gives the advantage that the mounting element can be easily mounted in the regulating device.

According to one aspect, the regulating device is formed by a metal wire, which gives the advantage that the regulating device can be produced at a low price while it obtains a high quality.

According to one aspect, the largest distance between the first and the second ends of the mounting element is greater than the distance between the points on the inside of the ventilation duct in which the damper is adapted to be mounted in, which gives the advantage that the force with which the mounting element is mounted against the ventilation duct increases.

According to one aspect, the regulating device comprises at least one regulating member, wherein each regulating member comprises a substantially circular hole.

According to one aspect, the regulating device comprises a helical portion and the ends of the regulating member are attached to the plate.

According to one aspect, the respective regulating member is mounted at the periphery of the plate.

According to one aspect, the mounting element comprises at its ends a substantially rectangular portion, which gives the advantage that the mounting element at least bears against the ventilation duct in four points, which improves the positioning of the mounting element.

According to one aspect, the mounting element is in the longitudinal direction symmetrical around its centre point.

According to one aspect, at least one of the first and second ends of the mounting element prevents a shape extending in at least two planes, which provides the advantage that the mounting element will bend resiliently in the same direction while being mounted. This in turn provides the advantage that the positioning of the plate can be predetermined in a simple and reliable way.

According to one aspect, the mounting element is adapted to be mounted against the regulating device by means of the mounting element bending resiliently against the regulating device.

According to one aspect, the force required to rotate the plate relative to the mounting element is greater than the power of the air flow adapted to being exerted of the plate, which provides the advantage that its regulation will not be altered by the air flow.

According to one aspect, the force that is opposed to the force from the air flow in the ventilation duct is a friction force between the mounting element and the regulating device.

According to one aspect, the mounting element is resiliently biased towards the regulating device.

According to one aspect, at least one of the first and second ends of the mounting element comprises a recess, wherein parts of the regulating device are adapted to be mounted in said recess. This provides the advantage that the position of the regulating device relative to the mounting element can be predetermined and that it will not alter during operation of the ventilation system.

According to one aspect, the plate is bent along its diameter, which provides the advantage that the regulation of the air flow in the ventilation duct can be performed effectively in relation to the angle with which the plate needs to be rotated.

A ventilation system in accordance with the independent claim comprises at least one damper according to the above, and a ventilation duct, which provides the advantages that the damper can be mounted and dismounted very easily without need for access to the outside of the ventilation duct.

According to one aspect, the damper is mounted in the ventilation duct so that the entire plate is outside the ventilation duct when the damper in its closed position, which provides the advantage that a lower sound image is attained than if the plate is placed within the ventilation duct.

According to one aspect, the damper is mounted in the ventilation duct so that some part of the damper is outside the ventilation duct when the damper is in its closed position, which provides the advantage that a lower sound image is attained than if the plate is placed inside the ventilation duct.

According to one aspect, the ventilation duct comprises on its inside a groove, and the mounting element is adapted to be mounted in said groove.

According to one aspect, the size of the air flow orifice can be continuously or gradually regulated between a maximum open position and a closed position and values lying there between, which means that the damper can regulate the air flow in the ventilation duct in a good and desired way. According to one aspect, the size of the air flow orifice depends on the position of the plate in relation to the ventilation duct.

The here described damper can also be mounted on existing ventilation systems. It can be installed in a ventilation system intended for constant flows, or in a system intended for adjustable fans.

DETAILED DESCRIPTION OF PREFERRED EMBODIMENTS

The here described damper is primarily an inlet air damper. However, the technical teaching may also be applied on exhaust air dampers. The following describes a ventilation system for an inlet air ventilation. The exhaust air ventilation works similarly.

Hereinafter, a ventilation system and a damper will be described more in detail with reference to FIGS. 1-15.

Figure 1:
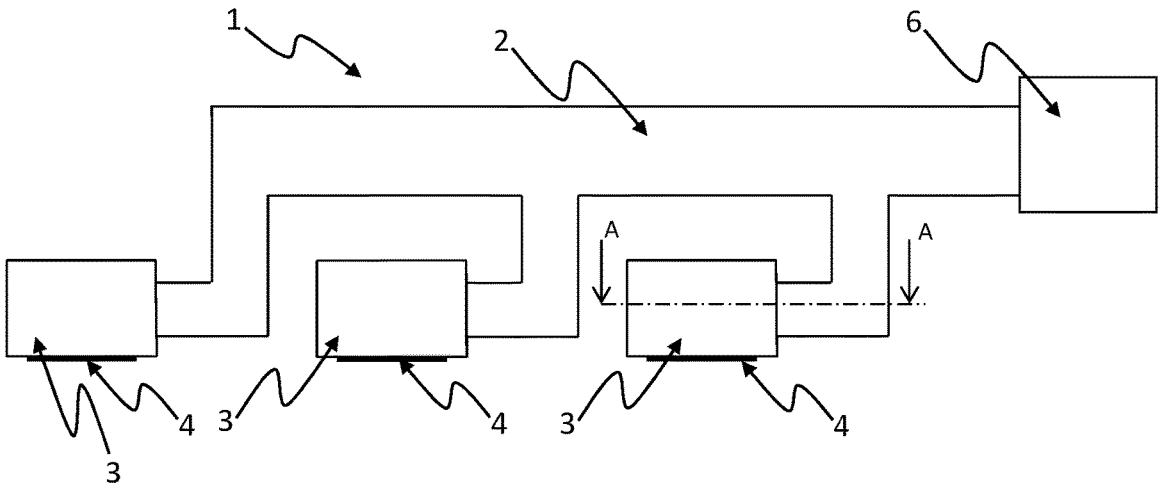
FIG. 1 shows schematically a ventilation system.

FIG. 1 schematically illustrates a ventilation system 1 of a type that is commonly occurring in various buildings, as described initially. The ventilation system 1 comprises a ventilation duct 2 to which a plurality of pressure equalizing boxes 3, ventilation devices 4 and dampers 5 (not shown in FIG. 1) are connected. The ventilation devices 4 and the dampers 5 can as shown in FIG. 1 be connected at different positions along the ventilation duct 2. The ventilation duct 2 as illustrated in FIG. 1 have one or a plurality of branches to which one or several pressure equalizing boxes 3, ventilation devices 4 and dampers 5 can be connected. The ventilation system 1 further comprises a fan 6. The fan is arranged to generate a pressure in the ventilation system 1 to achieve a forced ventilation. The ventilation system 1 as illustrated in FIG. 1 can be installed in buildings, i.e. habitations, and the ventilation duct 2 can extend over several different areas for the ventilation of these areas. It may concern inlet air ventilation or exhaust air ventilation.

Figure 2:
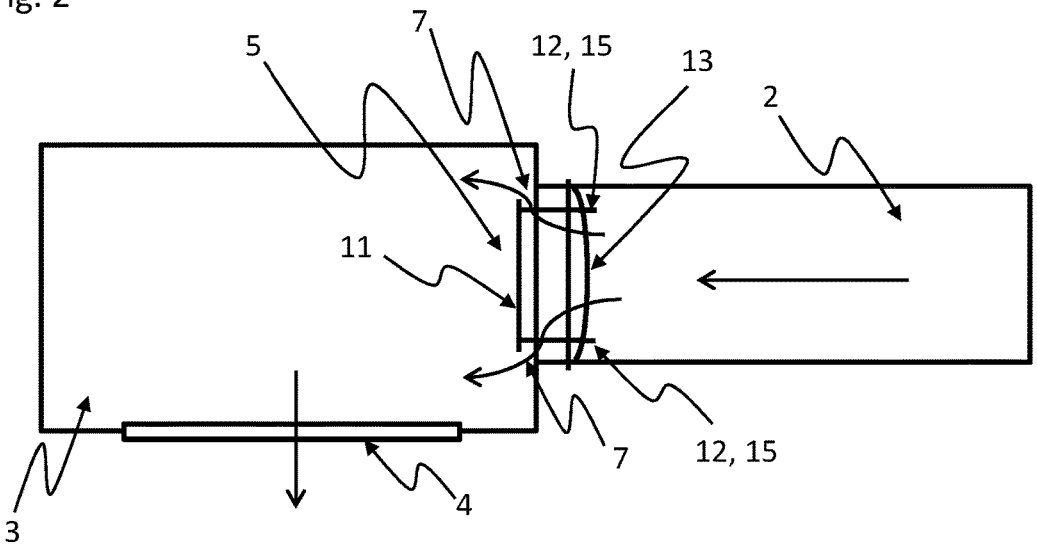
FIG. 2 shows a cross sectional view along B-B in FIG. 4 of a ventilation system with a damper in a closed position.

FIGS. 2-5 shows a part of a ventilation system 1 comprising a part of the ventilation duct 2, a pressure equalizing box 3, a damper 5 and a ventilation device 1. In FIG. 2, the damper 5 is in its closed position and in FIG. 3, the damper 5 is in its open position.

An air flow orifice 7 is provided between the damper 5 and the ventilation duct 2. Air can pass through the air flow orifice 7 and the size of the air flow orifice 7 regulates the amount of air flow that can pass through the damper 5 in the ventilation duct 2. When the damper 5 is in its closed position, FIG. 2, the air flow orifice 7 is in a closed position and when the damper 5 is in its open position, FIG. 3, the air flow orifice 7 is in a maximum open position. The size of the air flow orifice 7 is continuously or incrementally adjustable between its maximum open position and its closed position, as well as any value between these positions.

Figure 3:
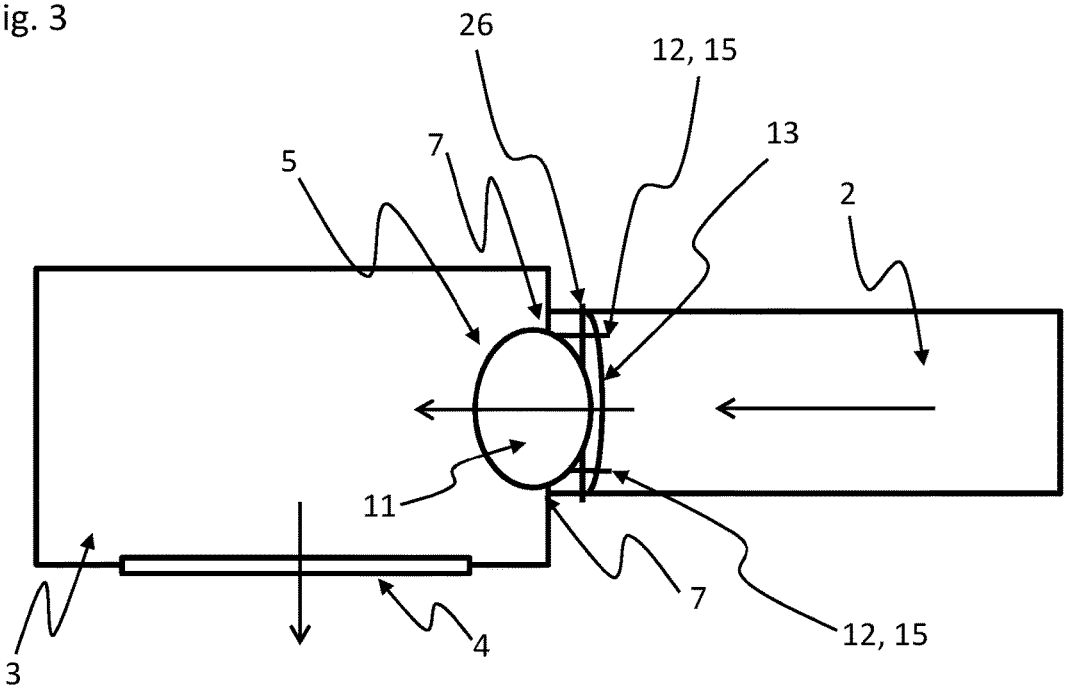
FIG. 3 shows a cross sectional view along B-B in FIG. 5 of a ventilation system with a damper in an open position.
Figure 4:
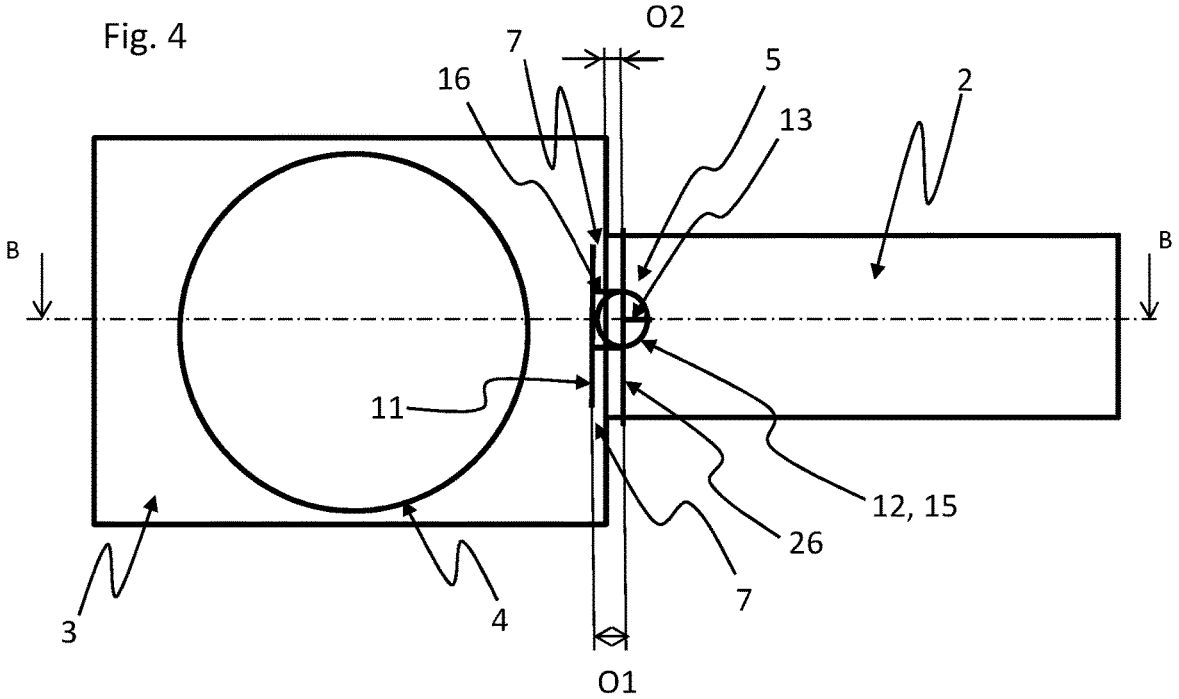
FIG. 4 shows a sectional view along A-A in FIG. 1 of a ventilation system with a damper in a closed position.
Figure 5:
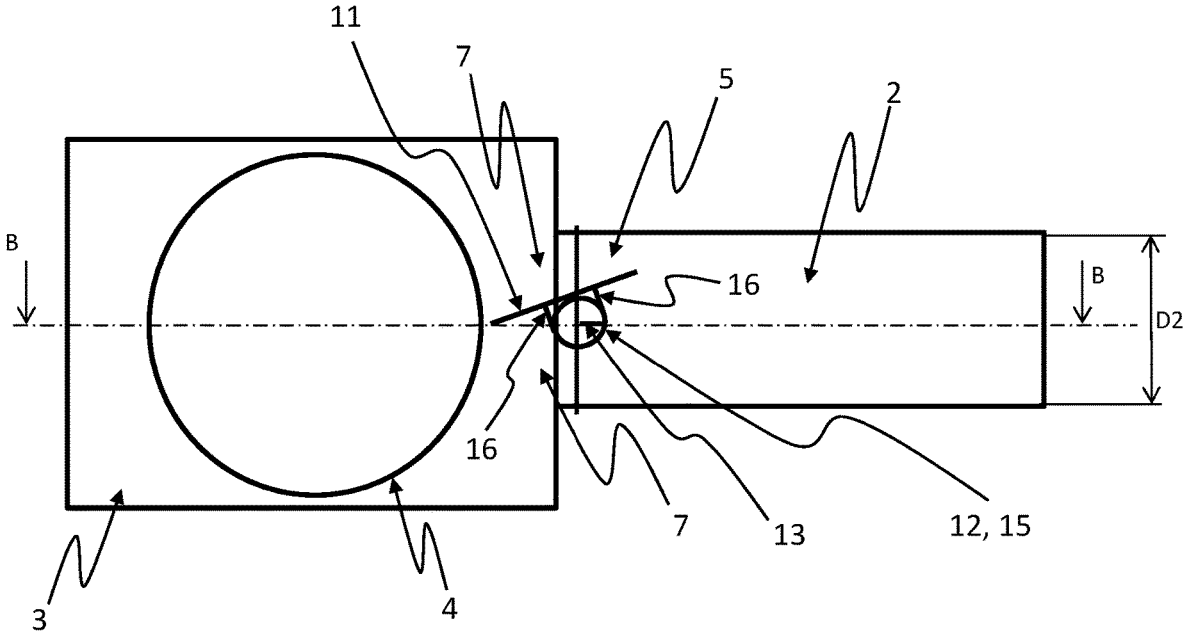
FIG. 5 shows a sectional view along A-A in FIG. 1 of a ventilation system with a damper in an open position.
Figure 6:
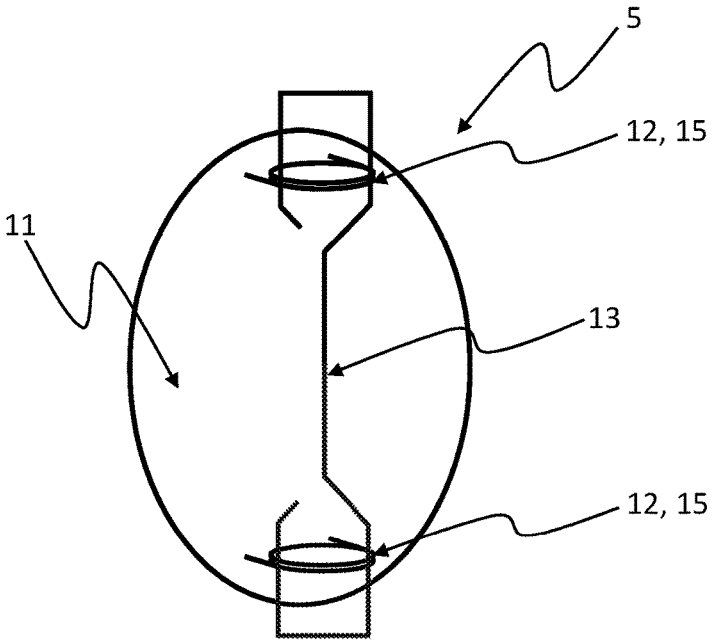
FIG. 6 shows a perspective view of a damper.

The air in the ventilation system 1 flows in the ventilation duct 2 through the air flow orifice 7 between the ventilation duct 2 and the damper 5, which is also illustrated by arrows in FIGS. 2 and 3.

Thereafter, the air flows further through to the pressure equalizing box 3. The pressure air flow is equalized in the pressure equalizing box 3. In the pressure equalizing box 3, the air can also pass through a "cooling unit" (not shown) to modify the temperature or the humidity of the air. How the air can be effected in the pressure equalizing box 3 will hereinafter not be described in detail. The air passes on from the pressure equalizing box 3 through the ventilation device 4 and further out into the area that is to be ventilated.

The ventilation device 4 can show a variety of forms and be located at the ceiling and on the wall of the area to be ventilated, which is generally known to one skilled in the art. Therefore, the ventilation device 4 will not be described more in detail hereinafter.

FIGS. 6-14, to which reference is now made, show a damper 5 comprising a plate 11, a regulating device 12 and a mounting element 13. The mounting element 13 is pivotally mounted on the regulating device 12. The regulating device 12 is mounted on the plate 11.

The plate 11 has a circular shape. The plate 11 comprises four holes 14 for mounting the regulating device 12 on the plate 11. The shape and the dimension of the plate 11 are designed in relation to the shape and the dimension of the ventilation duct 2 in which the damper 5 is to be mounted. The diameters D1 of the plate 11 is slightly smaller than the inner diameter D2 of the ventilation duct 2. As the diameter D1 of the plate 11 is slightly smaller than the inner diameter D2 of the ventilation duct 2, the plate 11 can be rotated in the ventilation duct 2.

According to one aspect, the plate 11 has a rectangular shape, a square shape or a triangular shape. The form of the plate 11 may substantially present a corresponding shape as the ventilation duct 2 in which it should be mounted.

The air flow orifice 7 between the damper 5 and the ventilation duct 2 is formed between the peripheral edge of the plate 11 and the inside of the ventilation duct 2.

Figure 9:
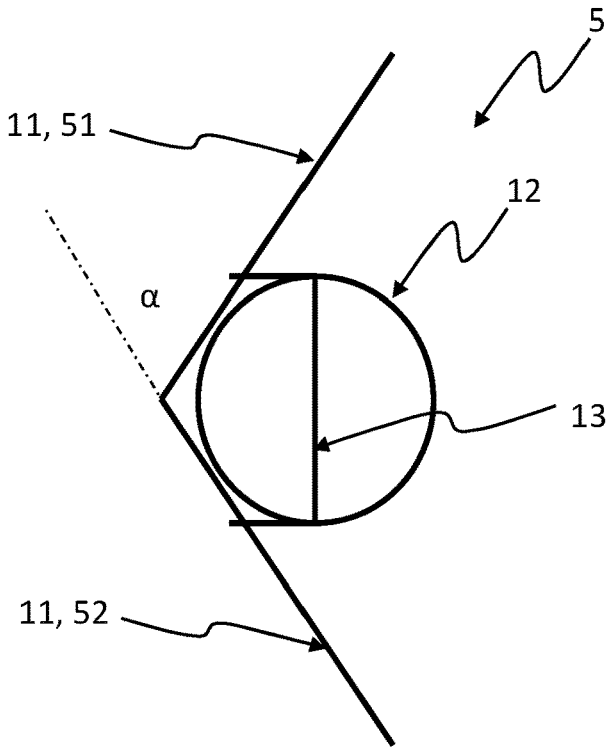
FIG. 9 shows a top view of a damper with a bent plate.
Figure 10:
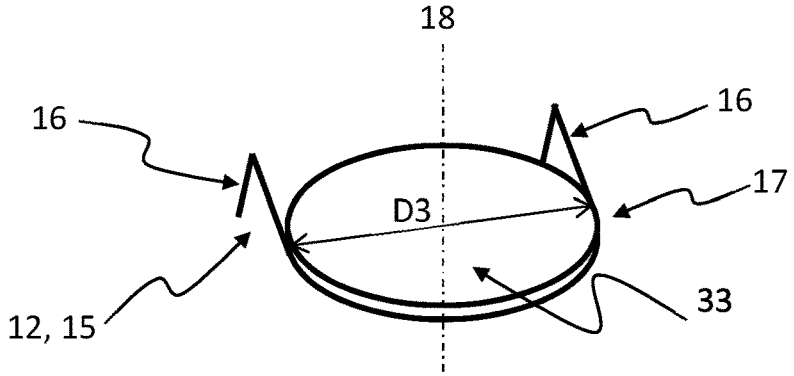
FIG. 10 shows a perspective view of a regulating device.

According to one aspect, which is shown in FIG. 9, the plate 11 is bent along its diameter so that it presents a first portion 51 and a second portion 52. The plate 11 is bent so that the first portion 51 is inclined at an angle α relative to the second portion 52. The bent shape of the plate 11 gives an improved regulation of the air flow orifice 7. According to one aspect, the angle α is 10-60°. According to one aspect, the angle α is 20-50°. According to one aspect, the angle α is 30-40°.

The regulating device 12 comprises two regulating members 15. The regulating member 15 comprises a substantially circular hole 33 with a diameter D3.

According to one aspect, the regulating member 15 is formed of a metal wire. The respective regulating member 15 comprises two wire ends 16. At each end of the wire 16, the regulating member 15 is bent at an angle. The regulating member 15 is between its wire ends 16 provided with a helical portion 17. The regulating member 15 is in this helical portion 17 twisted 460 degrees to a helical form so that the two wire ends 16 of the regulating member 15 are directed in the same direction. The helical portion 17 forms the substantially circular hole 33 and has a centre axis 18. The helical portion 17 has a diameter D3. The regulating device 12 is mounted onto the plate 11 by introducing a respective wire end 16 of the regulating wire into a respective hole 14 of the plate 11. The angled wire ends 16 cooperate with the holes 14 of the plate 11 so that the centre axis 18 of the helical portion 17 is parallel with the radial extension of the plate. The centre axis 18 of the helical portion 17 is located at a distance O1 from the plate 11. The length of the angled wire ends 16 substantially correspond to half of the diameter D3 of the helical portion, which means that the helical portion 17 will after mounting bear against the plate 11 and lock the regulating member 15 against the plate.

Figure 12:
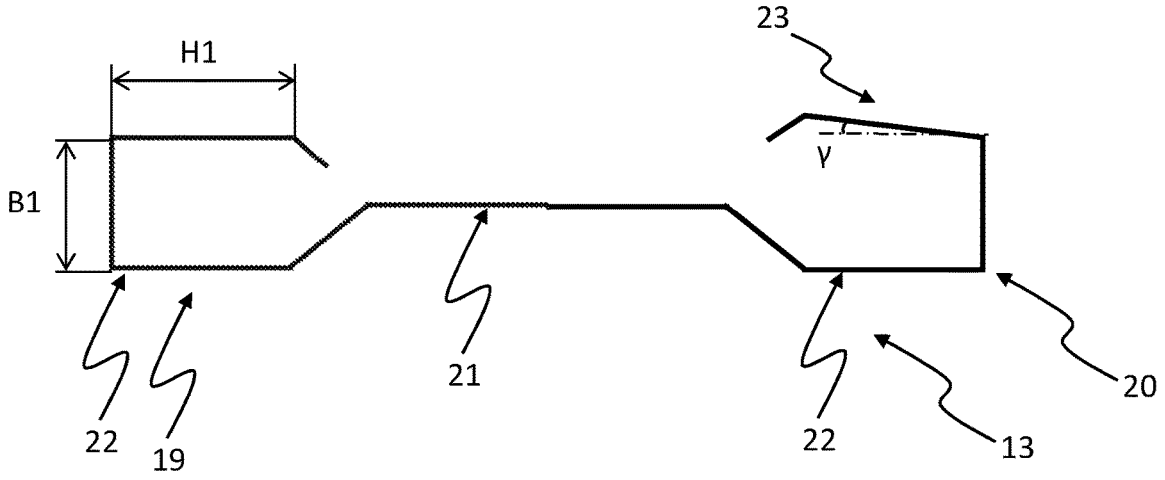
FIG. 12 shows a perspective view of a mounting element.

The mounting element 13 has a first end 19 and a second end 20. The mounting element 13 comprises a mounting wire 21. The mounting wire 21 is mirror image shaped around its centre. The mounting wire 21 comprises at its first and second ends 19, 20 a rectangular portion 22 with a width B1 and a height H1 in the mounted state. The mounting wire 21 has in the rectangular portion 22 been drawn in one plane to a shape having three sides, two lateral sides 23 and one top portion 24, of a rectangle. FIG. 12 shows the first end 19 with the rectangular shape which it present when it has been mounted in the regulating device 12. Den other end 20 is shown with the shape which it has in a not mounted state. In the not mounted state, one lateral portion 23 is angled outwards at an angle γ. When the first and the second ends 19, 20 are mounted in the regulating device 12, the lateral part 23 is resiliently moved inwards and presses thereafter outwards against the regulating device 12. The width B1 of the rectangular part 22 is adapted to the diameter D3 of the substantially circular holes 33 of the regulating device 12.

The mounting element 13 is mounted to the regulating device 12 by introducing the respective first and second ends 19, 20 into the helical portion 17 of the respective regulating wire 15. The width B1 of the first respectively second ends 19, 20, i.e. the width B1 of the rectangular shaped portion 22 of mounting wire in FIG. 12, is the same or slightly less that the diameter D3 of helical portion 17 of the regulating device 12, and with regard to the substantially circular hole 33. When the first and second ends 19, 20 are inserted in the respective helical portion 17, a side part 23 of the rectangular shaped portion 22 is slightly elastically moved inwards. In the mounted position, the side parts 23 press outwardly with a force against the helical portion 17.

Figure 14:
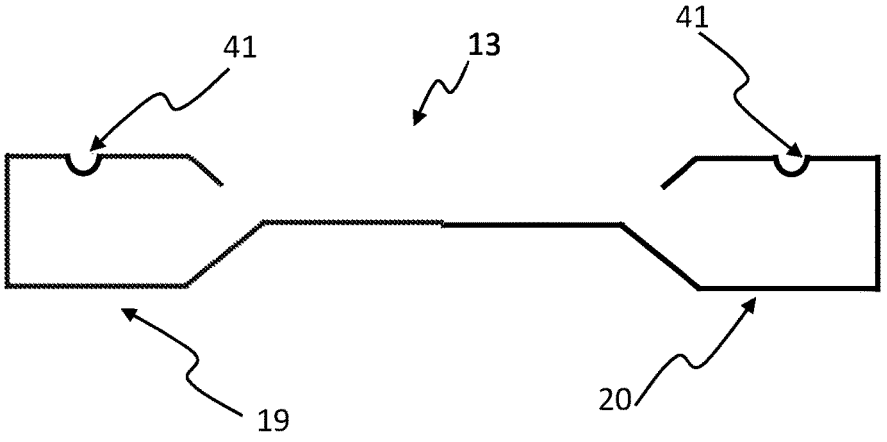
FIG. 14 shows a perspective view of a mounting member with recesses.

The first and second ends 19, 20 of the mounting element 13 can according to one aspect, see FIG. 14, comprise a recess 41. When the mounting element 13 is mounted onto the regulating device 12, the recess 41 of the first and second ends 19, 20 will attach the mounting element 13 against the regulating device 12. The recess 41 results in a locking of the position in height of the regulating device 12 to lock relative to the mounting element 13. By changing the position of the recess 41, the position in height between the regulating device 12 and mounting element 13 can thus be modified.

Figure 11:
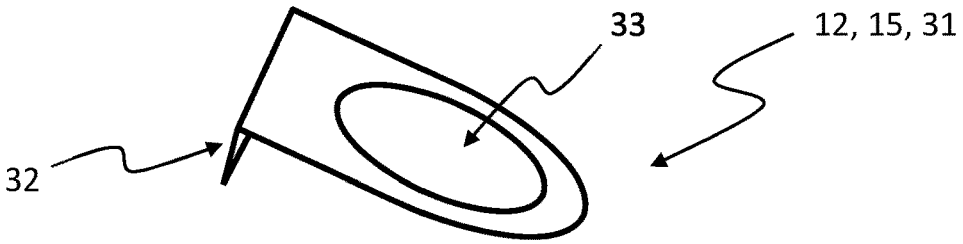
FIG. 11 shows a perspective view of a regulating device.

According to one aspect, which is shown in FIG. 11, the regulating member 15 of the regulating device 12 may comprise a plate 31 having a bent part 32 with a hole 33. The bent part 32 is attached against the plate 11 by welding, riveting, screwing or other suitable attachment method. The hole 33 has a function corresponding to that of the helical portion 17 as above and has a diameter that is adapted to the width of the mounting element 13. The mounting element 13 is mounted onto the regulating device 12 in the same way as described above.

The mounting element 13 is rotatable about the centre axis 18 of the regulating device 12. In order to rotate the mounting element 13 relative to the regulating device 12, a force needs to be applied to the regulating device 12 that exceeds the frictional force between the mounting element 13 and the regulating device 12. The frictional force depends on the material of the mounting element 13 and of the regulating device 12, and of the force with which mounting element 13 presses against the regulating device 12.

Figure 7A:
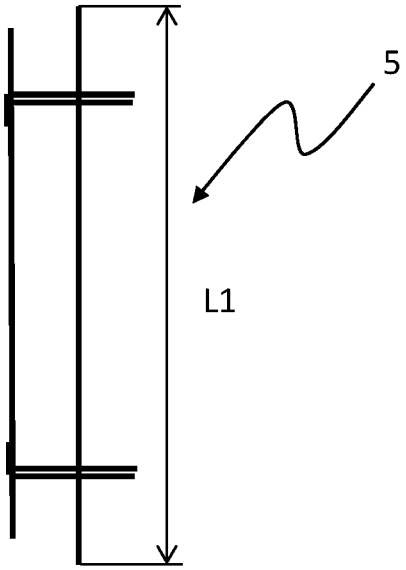
FIG. 7A shows a lateral view of a damper in a not mounted state.
Figure 7B:
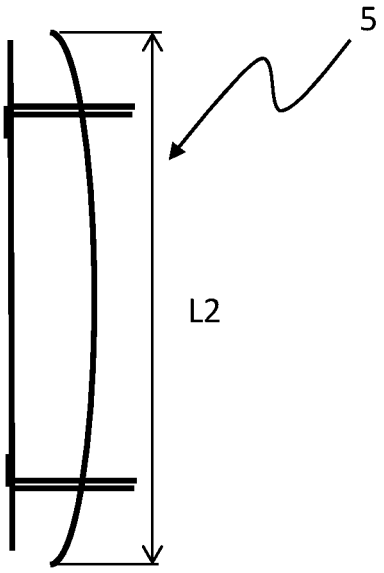
FIG. 7B shows a lateral view of a damper in a mounted state.
Figure 8:
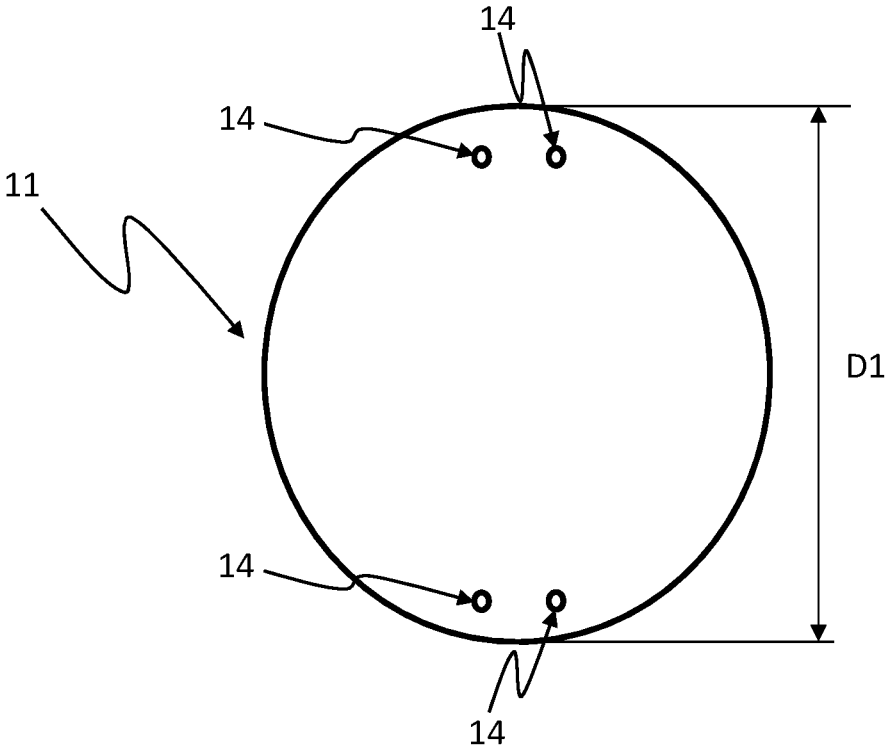
FIG. 8 shows a front view of a plate.

The mounting element 13 has a length L1 from its first end 19 to the other end 20 when it is in its resiliently unloaded state, see FIG. 7A. The mounting element's 13 length L1 is conceived in relation to the size of the ventilation duct 2 into which it is intended to be installed. In case the damper 5 is to be mounted in a circular ventilation duct 2, then the length L1 is adapted to the inner diameter of the ventilation duct 2. The mounting element 13 has a length L2 from its first end 19 to its other end 20 when it is in its resiliently loaded state, see FIG. 7B. The length L2 is inferior to the length L1. When the mounting element 13 is effected by a force, then the mounting element 13 will bend resiliently into an arcuate shape and thereby, the distance between its first end 19 and its second end 20 will modified.

The mounting element 13 is resilient in its longitudinal direction. When the mounting element 13 bends resiliently, its first and second ends 19, 20 will be pressed against each other and the distance between the first and second ends 19, 20 decrease. The distance between the first and second ends 19, 20 of the mounting element 13 is greatest in its unbiased position. The first and second ends 19, 20 of the mounting element 13 are placed to bear against the inside of the ventilation duct 2 to cooperate with the inside of the ventilation duct 2 for mounting the damper 5 in the ventilation duct 2. The mounting element 13 needs to be effected by an external force to bend resiliently. When the mounting element 13 is biased by a force being applied on the same, the mounting element 13 is bent to an arcuate shape, see FIG. 7B, and the distance between its first and second ends 19, 20 decreases.

The spring force of the mounting element 13 depends on several parameters, amongst others the necessary spring force, which is to be applied onto the mounting element 13 so as to bring the mounting element 13 to bend resiliently, has to be modified by changing the material, the length L1, the height H1 of the rectangular part, the thickness of the mounting wire 21 of the mounting element 13. Each of the mentioned parameters individually modify the required spring force.

The length L1 of the mounting element 13 is also adapted to the diameter D4 of a groove 26 of the ventilation duct 2 into which the damper 5 is intended to be mounted. The length L1 should be equal to or greater than the diameter D4 of the groove 26.

The shape to which the mounting wire 21 has been drawn in its first and second ends 19, 20 can be other than rectangular, they can for example be triangular.

Figure 13:
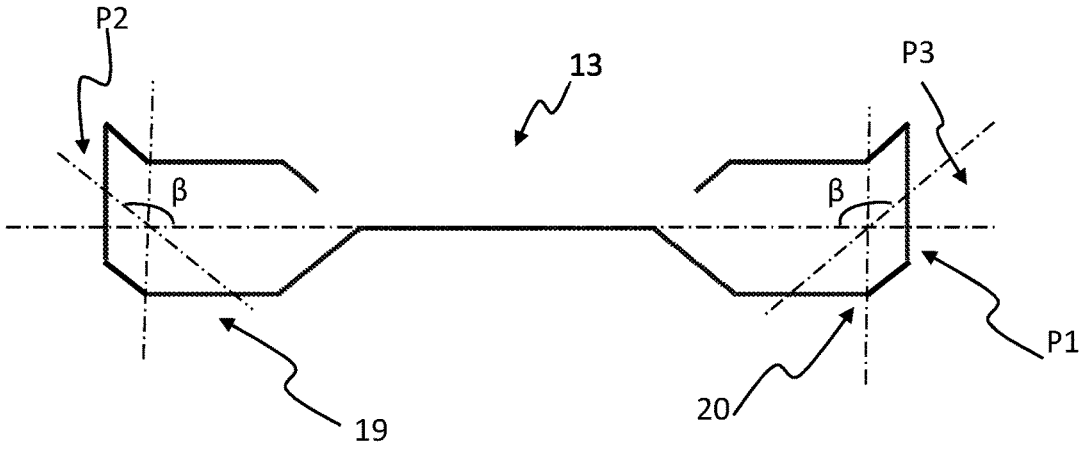
FIG. 13 shows a perspective view of a further mounting element.

FIG. 13 shows a mounting element 13, the first and second ends 19, 20 of which are angled at an angle so they have an extension in two planes. A first plane P1 that is parallel with the length L1, L2 of the mounting element 13 and a second and a third plan P2, P3 showing an extension at an angle β relative to the first plane P1. The lateral parts 23 of the rectangular part 22 of the mounting element 13 have been bent upwards so that the top part 24 of the mounting element 13 has been folded upwards. The angled first and second ends 19, 20 of the mounting element 13 cause the mounting element 13 to spring in the same way when a force is applied onto its first and second ends 19, 20. When a force is applied against the angled first and second ends 19, 20 of the mounting element 13, the mounting element 13 will bend resiliently to an arcuate shape depending on the angle of the first and second ends 19, 20. In this way, the resilience of the mounting element 13 can be predetermined, i.e. if it should have an arcuate shape bulging against or with the air flow in the ventilation duct 2.

Figure 15:
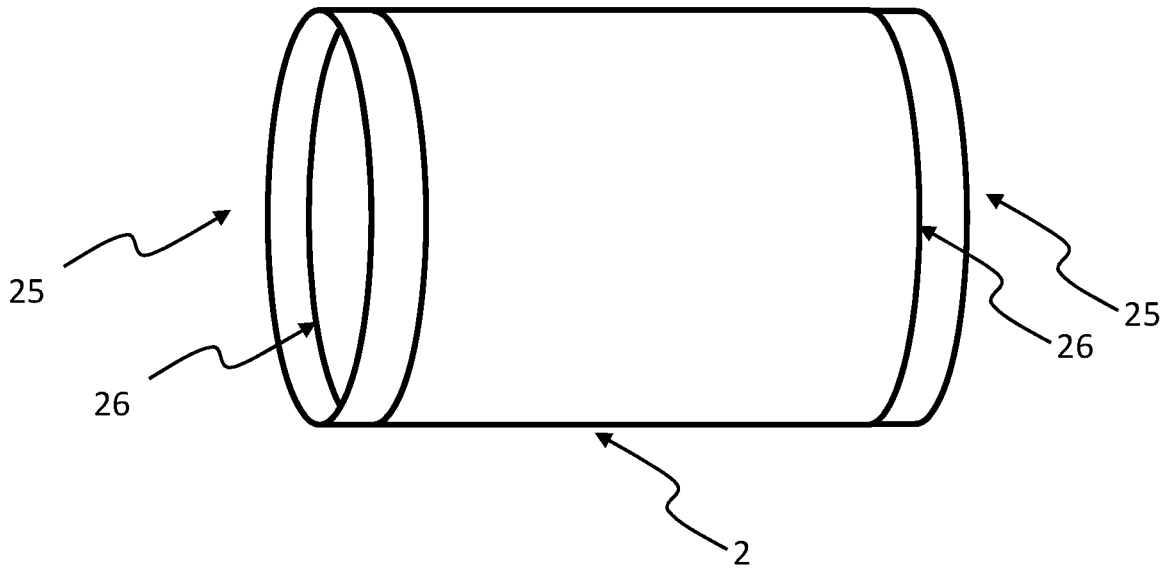
FIG. 15 shows a perspective view of a ventilation duct.

FIG. 15 shows of a ventilation duct 2. A circle-shaped groove 26 is formed at the end 25 of the ventilation duct. The groove 26 extends in a circle around the inside of the ventilation duct 2. The diameter D4 of the circle-shaped groove 26 is larger that the inner diameter D2 of the inside the ventilation duct 2. The groove 26 is located at a distance O2 from the end of the ventilation duct 2. Grooves 26 as above are commonly known and exist in ventilation ducts 2 and, consequently, the groove in it self will not be described more in detail. The groove 26, which with reference to the FIG. 15 has been described as arranged in the ventilation duct 2, can also be located in a pipe of the pressure equalizing box 3. The groove 26 may also be located elsewhere at the ventilation duct 2 than at its ends.

According to one aspect, the groove 26 is formed between two inwardly bulging grooves in the ventilation duct 2. The diameter of the groove 26 may be the same as the inner diameter D2 of the ventilation duct 2 and the diameter of the two inwardly bulging grooves is smaller than the inner diameter D2 of the ventilation duct 2.

Next, a method to mount and dismount a damper 5 will be described with reference to FIGS. 2-15.

When the damper 5 is to be mounted in the ventilation duct 2, the damper 5 is inserted into the ventilation duct 2 and the first end 19 of the mounting element 13 is applied against the inside of the ventilation duct 2 in form of the groove 26. Then the damper 5 is turned upwards and thus the other end 20 of the mounting element 13 will go against ventilation duct 2. Thereafter, damper 5 is pushed further inwards with a force that is greater than the spring force of the mounting element 13. When the mounting element 13 is exposed to the force it will bend resiliently and the distance between its first and second ends 19, 20 decreases. The distance is reduced by the mounting element 13 bending resiliently and adopting an arcuate shape. When the distance between the first and second ends 19, 20 decreases, the damper 5 can be rotated further inwardly until the second end 20 of the mounting element 13 is located at the groove 26 of the inside of the ventilation duct 2. When the other end 20 of the mounting element 13 is located at the groove 26, then the mounting element 13 will bend resiliently outwardly and the other end 20 will now be located in the groove 26.

The damper 5 is now in its mounted position in the groove 26 of the ventilation duct 2. In the mounted position, the mounting element 13 is parallel to the diameter of the ventilation duct and perpendicular to the air flow of the ventilation duct 2. In its mounted position, plate 11 and regulating device 12 can be rotated relative to the mounting element 13 in the ventilation duct 2 to set the damper 5. When the plate 11 is rotated, the damper 5 is moved between its open and its closed position. The plate 11 can be rotated by the installer pressing with his hand directly on the plate, or otherwise strings may be mounted on the damper 5 so that the plate 11 can be rotated via the strings.

The force that has to be applied to the plate 11 and the regulating device 12 for rotating it relative to the mounting element 13, i.e. the force needed to overcome the frictional force between the regulating device 12 and the mounting element 13, is greater than the force by which the air in the ventilation duct 2 effects the damper 5. In this way, the air flow will change the setting of the damper.

In order to dismount the damper 5, a force is applied to the centre of the mounting element 13, which force is greater than this spring force of the same so that the mounting element 13 bends resiliently into its arcuate shape. When the mounting element 13 bends resiliently, the distance L2, L1 between the first and the second ends 19, 20 will be reduced and when the distance between the first and the second ends 19, 20 is less the inner diameter D1 of the ventilation duct, then the mounting element 13 will loosen from the groove 26. The damper 5 may then be moved out from the ventilation duct 2.

The distance O1 between the centre axis 18 of regulating device 12 and the plate 11 is larger than the distance O2 between the groove 26 and the end of ventilation duct 2. In this way, the plate 11 of damper 5 will be placed outside the ventilation duct 2 when the damper 5 is in its closed position and when the mounting element 13 is mounted in the groove 26 of the ventilation duct.

Tests on ventilation systems 1 for inlet air have shown that the sound generated by the damper 5 is significantly reduced if some part of the damper 5 is located outside the ventilation duct 2.

When the ventilation duct 2 is to be cleared from dirt and incrustations, the inside of the ventilation duct 2 has to be cleaned with a cleaning tool. To have access to the inside of the ventilation duct 2, the ventilation device 4 and the damper 5 have to be removed from the ventilation system 1. The damper 5 is easily accessible from the inside of the ventilation duct 2 via pressure equalizing box 3. This means that dismounting the damper 5 can be carried out easily and time efficiently without need for access to the outside of the ventilation duct 2. The outside of the ventilation duct 2 is often built-in in suspended ceilings and the like, which means that the access to the outside often difficult and entails damages on other parts such as ceilings. When the damper 5 is dismounted, the ventilation duct 2 may be cleared. When the ventilation duct 2 is cleared, the damper 5 may be refitted in accordance with the above method.

Figure 16:
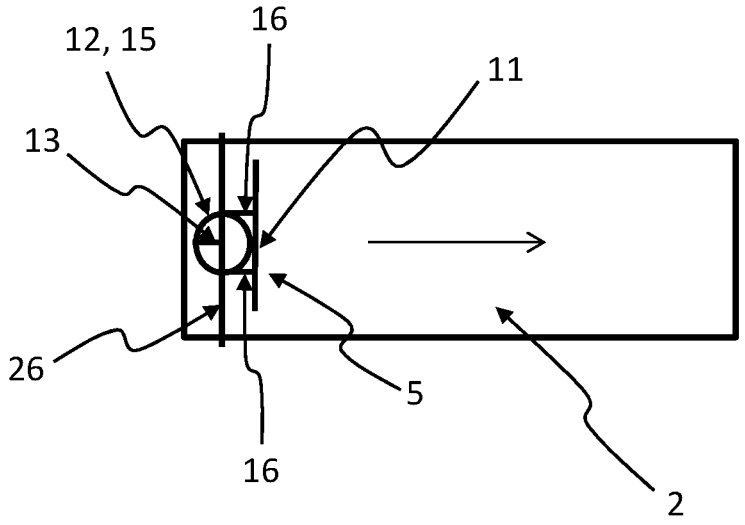
FIG. 16 shows a sectional view of a ventilation duct with a damper for exhaust air.

FIG. 16, to which reference is now made, shows an aspect in which the damper 5 is mounted in a ventilation duct 2 intended for a ventilation system 1 for exhaust air in which the air is intended to flow in the direction of the arrow. The damper 5 is mounted in same way as in a ventilation system 1 for inlet air in relation to the intended air flow. This means that the damper 5 is mounted with the regulating device 13 facing the end of the ventilation duct 2.

The ventilation system 1 has been described as a ventilation system that comprises a circular cross section. In a circular ventilation system 1, the damper 5 has the advantage that the positioning of the damper 5 in the ventilation duct 2 is simplified. However, the invention should not be considered as limited to circular ventilation systems 1, and may also be applied to other systems such as square systems, elliptical systems etc.

The above ventilation system 1 has been described with a ventilation duct 2 provided with a groove 26. However, the damper 5 can also be mounted against the inside of the ventilation duct 2 without a groove. The damper 5 can also be mounted against the inside of a ventilation duct 2 having a groove, but then the damper is mounted against a part of an inside of the ventilation duct 2 that is not constituted by the groove.

The invention is not limited to the above-described embodiment examples shown on the drawings, but can freely vary within the scope of the appended patent claims.

The invention claimed is:

1. A damper adapted to regulate an air flow orifice for the passage of an air flow in a ventilation duct, comprising:

a plate, a regulating device comprising at least one circular hole, and a mounting element comprising a first end, a second end, and a resilient mounting wire extending between the first and second ends, wherein the plate is mounted to the regulating device and the regulating device is mounted to the mounting element, wherein the circular hole of the regulating device receives the mounting element and a portion of the mounting element that establishes a rotational physical interaction between the mounting element and the regulating device is resiliently biased against the circular hole of the regulating device, wherein a distance between the first end and the second end of the mounting element decreases due to bending of the resilient mounting wire during mounting of the damper in the ventilation duct, wherein the first end and the second end cooperate with an inside of the ventilation duct to removably mount the damper in the ventilation duct, and wherein the regulating device and the plate rotate relative to the mounting element between an open position of the damper and a closed position of the damper under force applied to the regulating device that exceeds a frictional force between the mounting element and the regulating device.

2. The damper according to claim 1, wherein the first and second ends cooperate with an internal groove of the ventilation duct.

3. The damper according to claim 1, wherein the mounting element is mounted perpendicularly to the direction of the air flow in the ventilation duct.

4. The damper according to claim 1, wherein the plate is spaced at a distance in the direction of the air flow from the mounting element by the regulating device.

5. The damper according to claim 1, wherein the plate is circular.

6. The damper according to claim 1, wherein the regulating device is formed from a metal wire.

7. The damper according to claim 1, wherein a maximum distance between the first and the second ends of the mounting element is greater than a distance between two opposite points on the inside of the ventilation duct.

8. The damper according to claim 1, wherein the regulating device comprises at least one regulating member, wherein each regulating member comprises the circular hole through which the mounting element extends.

9. The damper according to claim 1, wherein the regulating device comprises a helical portion and ends of the regulating device are attached to the plate.

10. The damper according to claim 8, wherein a portion of the mounting element that establishes the rotational physical interaction is rectangular.

11. The damper according to claim 1, wherein the mounting element is in longitudinal direction symmetrical around its centre point.

12. The damper according to claim 1, wherein at least one of the first and second ends of the mounting element presents a shape extending in at least two planes.

13. The damper according to claim 1, wherein a force required to rotate the regulating device relative to the mounting element is greater than a force of the air flow in the ventilation duct transferred to the regulating device by way of the plate.

14. The damper according to claim 13, wherein the frictional force between the mounting element and the regulating device opposes movement of the plate under the force of the air flow in the ventilation duct.

15. The damper according to claim 1, wherein at least one of the first and the second ends of the mounting element comprises a recess, wherein a portion of the regulating device is mounted in the recess.

16. The damper according to claim 1, wherein the plate is bent along its diameter.

17. A ventilation system comprising the damper according to claim 1, and the ventilation duct.

18. The ventilation system according to claim 17, wherein the damper is mounted in the ventilation duct so that the entire plate is outside the ventilation duct when the damper is in a closed position.

19. The ventilation system according to claim 17, wherein the damper is mounted in the ventilation duct so that some part of the damper is outside the ventilation duct when the damper is in a closed position.

20. The ventilation system according to claim 17, wherein the inside of the ventilation duct comprises a groove, and the first and second ends of the mounting element are mounted in the groove.

21. The ventilation system according to claim 17, wherein a size of the air flow orifice depends on a position of the plate relative to the ventilation duct.

* * * * *